United States Patent [19]

Lück et al.

[11] Patent Number: 4,777,681

[45] Date of Patent: Oct. 18, 1988

[54] CUSHION WITH STUFFING OF FOAMED MATERIAL

[76] Inventors: Werner Lück, Grüner Weg 6; Reinhold Ohters, Neustr. 26, both of D-4290 Bocholt, Fed. Rep. of Germany

[21] Appl. No.: 17,812

[22] Filed: Feb. 24, 1987

[30] Foreign Application Priority Data

Mar. 13, 1986 [DE] Fed. Rep. of Germany ..... 3608342
Jan. 8, 1987 [EP] European Pat. Off. ..... 87100114

[51] Int. Cl.[4] ..... A47C 27/14

[52] U.S. Cl. ..... 5/464; 5/481; 5/502; 5/471

[58] Field of Search ..... 5/417, 420, 464, 481, 5/500, 502, 471

[56] References Cited

U.S. PATENT DOCUMENTS 3,242,508 3/1966 Smithson ..... 5/502
3,504,387 4/1970 Hummel ..... 5/500
3,828,378 8/1974 Flam ..... 5/481 X
4,042,986 8/1977 Goodman et al. ..... 5/500
4,042,987 8/1977 Rogers ..... 5/464
4,096,595 6/1978 Eide et al. ..... 5/471

FOREIGN PATENT DOCUMENTS 1559851 1/1980 United Kingdom ..... 5/464

*Primary Examiner*—Michael F. Trettel
*Attorney, Agent, or Firm*—Peter K. Kontler

[57] ABSTRACT

A cushion wherein a case defines a pocket for a stuffing which is composed of one or more layers of foamed plastic material. The layer or layers have straight slits each of which extends all the way through the respective layer and is disposed in a plane extending at right angles to the outer sides of such layer. Each slit extends at right angles to at least one neighboring slit and the layer or layers are connected to each other and to the panels of the case by spots or lines of adhesive, weldant and/or yarn. The cushion can be used in motor vehicles, upholstered furniture, beds, toys, clothing and mattresses.

17 Claims, 4 Drawing Sheets

CUSHION WITH STUFFING OF FOAMED MATERIAL

BACKGROUND OF THE INVENTION

The invention relates to cushions in general, and more particularly to improvements in cushions of the type wherein the case confines a stuffing which consists of or contains a foamed material.

Certain presently known cushions which contain stuffings of foamed material comprise cases which are made of polyester fibers forming a bulked wadding around the stuffing. Such cushions are known for nearly three decades and they are furnished in weight ranges of 40–1000 grams per square meter. Presently preferred fields of utilization of these cushions are for use as pillows in beds, as yieldable coatings for the cores of pieces of upholstered furniture, as coatings or paddings for the skeletons of mattresses, in the clothing industries and in the toy industries (particularly for the making of stuffed animals).

A wadding is satisfactory when the cushion is not subjected to prolonged deforming stresses and is not exposed to moisture. Therefore, the field of applications of a cushion which employs a case in the form of a wadding of polyester fibers or the like is rather limited if the part (e.g., a piece of upholstered furniture) wherein the cushion is to be employed must stand long periods of satisfactory use. Wetting of pieces of upholstered furniture, mattresses, toys and nearly all other parts which constitute or embody cushions is practically unavoidable. The appearance of a cushion wherein a stuffing of foamed plastic material is confined in a bulked case containing polyester fibers and serving to impart to the product an eye-pleasing appeal will be unduly affected when the cushion is subjected to longer-lasting deforming stresses and/or when the cushion is exposed to moisture. The situation is aggravated if the cushion is sat upon because the combination of body heat, perspiration and pressure promotes the deterioration of the wadding, especially as a result of contact with moisture. In many instances, the volume of the cushion is reduced to less than one-third of the original bulk. This not only affects the appearance of the cushion but also causes discomfort to the occupant of a seat or chair which is provided with such cushion because the compacted cushion acts not unlike a relatively hard board and the case develops numerous folds and creases which are felt by the person sitting or lying on the cushion.

The situation is not improved if the aforediscussed conventional cushion is provided with a thicker or stronger case in the form of a bulked wadding. This is due to the fact that a slab of foamed plastic material which forms the stuffing of a cushion does not exhibit the suppleness and conformability of down or other naturally occurring materials so that its exposure to prolonged deforming stresses and/or moisture invariably affects the quality of the cushion, especially the ability of the cushion to yield in a manner which affords comfort to the occupant or occupants of a seat, chair, bed, mattress or the like.

OBJECTS AND SUMMARY OF THE INVENTION

An object of the invention is to provide a cushion wherein the stuffing need not be confined in a wadding and wherein the foamed stuffing exhibits a more satisfactory elasticity, pliability and resiliency (i.e., ability to restore its original shape) than heretofore known stuffings of foamed material.

Another object of the invention is to provide a cushion wherein the foamed stuffing is shaped in a novel and improved way and wherein the stuffing is connected to the surrounding case in a manner deviating from the manner of attaching stuffings in heretofore known cushions.

A further object of the invention is to provide a novel and improved method of enhancing the elasticity of foamed stuffings for use in cushions and the like.

An additional object of the invention is to provide a novel and improved case for use in conjunction with the above outlined stuffing.

Still another object of the invention is to provide a cushion which embodies the above outlined stuffing and whose aerating, conditioning and many other properties are superior to those of the aforediscussed conventional cushions employing stuffings of foamed plastic material.

An additional object of the invention is to provide a cushion whose useful life is longer than that of conventional cushions.

Another object of the invention is to provide a cushion which is less affected by prolonged deforming stresses and/or moisture than heretofore known cushions which employ stuffings of foamed material.

A further object of the invention is to provide a cushion which can more readily conform to the outline of a deforming body (e.g., a human torso) than heretofore known cushions having stuffings of foamed plastic material.

The improved cushion comprises a stuffing which includes at least one layer consisting of a foamed material and having a plurality of slits which extend all the way between the two sides of the layer, a case for the stuffing, and means for connecting spaced-apart portions of the layer or layers to the case. Each slit is or can be disposed at right angles to at least one neighboring slit, and the slits are preferably disposed in planes extending substantially at right angles to the sides of the layer or layers. The slits are or can be straight.

The case preferably includes two panels which define a pocket for the stuffing and, if the stuffing comprises two or more neighboring layers of foamed material, spaced-apart portions of such neighboring layers are preferably connected to each other by spots, lines or patches of adhesive, by welding, by stitches or in another suitable way. The case can comprise several different portions; for example, the color, thickness, flexibility and/or other characteristics of one panel of a twin-panel case can deviate from the corresponding characteristic or characteristics of the other panel.

At least one marginal portion of the single layer, or of the two outer layers of a stack of two or more layers, can be secured to the adjacent portion or portions of the case, e.g., by stitches.

The arrangement is or can be such that the central portion of a layer can comprise a larger number of slits per unit area than the surrounding outer portion of the respective layer. It is also possible to provide slits only in the central portion of a layer.

The thickness of the stuffing need not appreciably exceed 81 mm, and the thickness of a layer need not appreciably exceed 41 mm.

The novel features which are considered as characteristic of the invention are set forth in particular in the appended claims. The improved cushion itself, however, both as to its construction and the mode of making the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
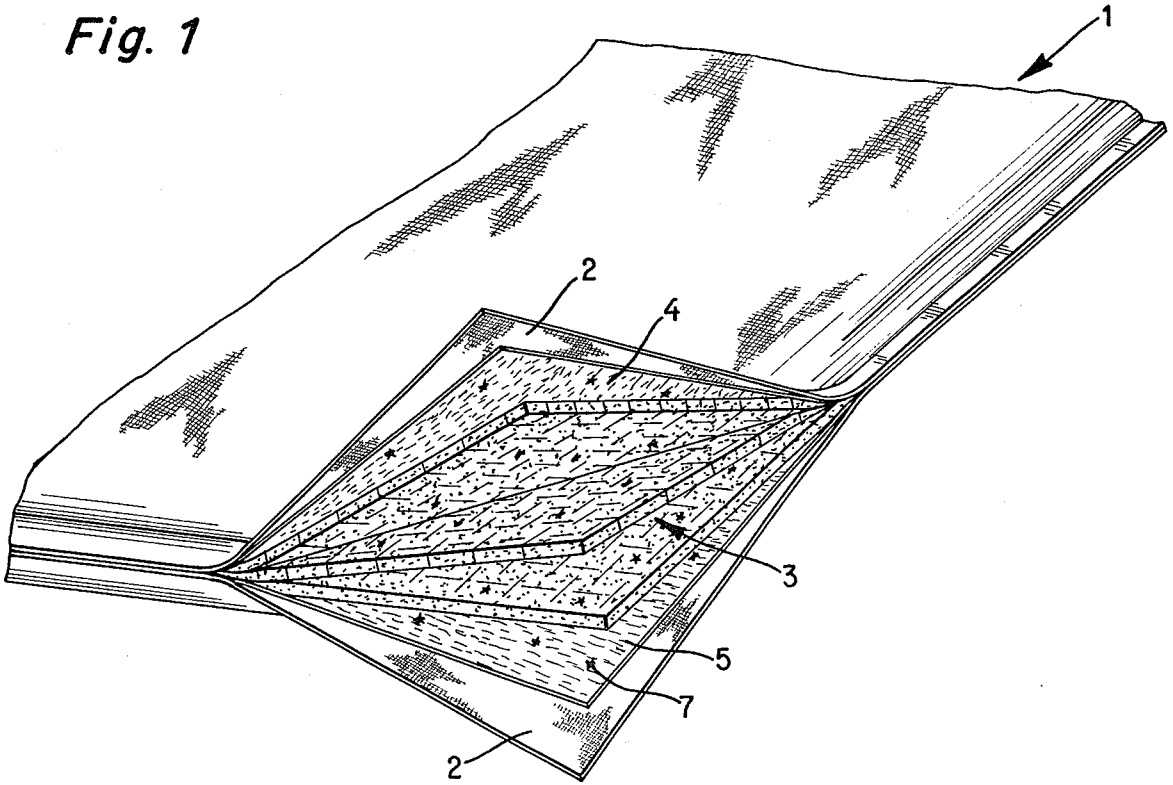
FIG. 1 is a fragmentary perspective view of a cushion which embodies one form of the invention and wherein the stuffing comprises three layers of foamed material, one corner portion of the outer envelope and of the case being shown in opened condition in order expose the layers of the stuffing.
Figure 4:
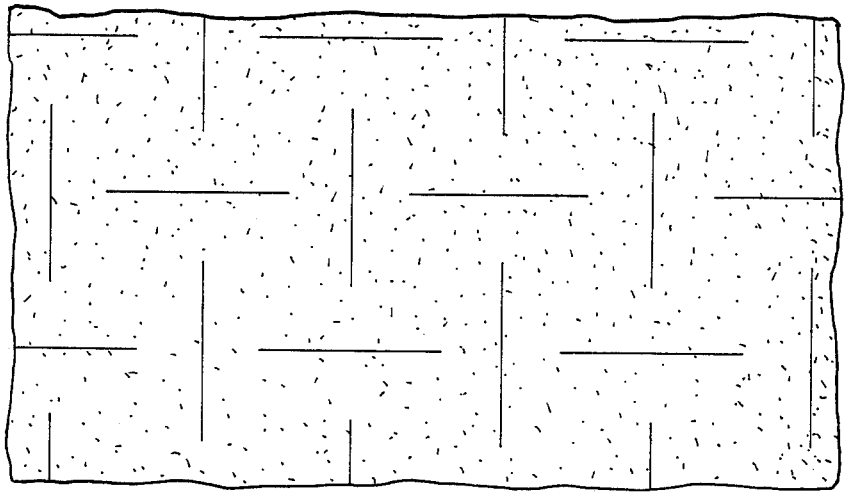
FIGS. 3 to 8 illustrate six additional patterns of slits.
Figure 3:
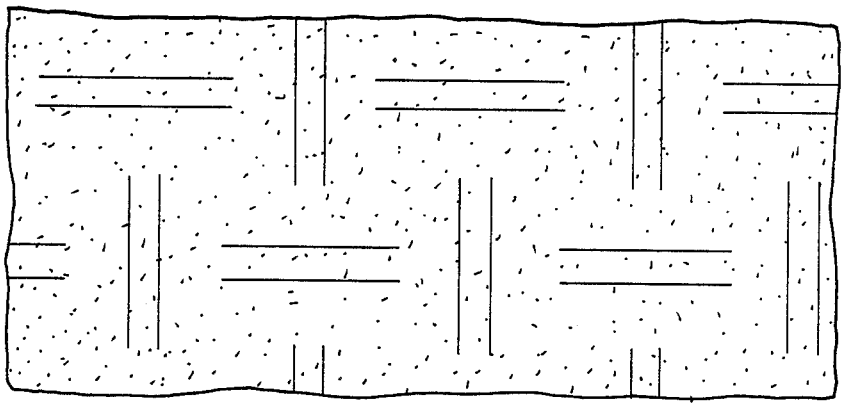

FIG. 1 shows a portion of a substantially flat polygonal cushion or pad 1 having an outer envelope 2 of cotton or any other suitable material, a case comprising two panels 4, 5 which define a pocket for a composite stuffing 3 having three superimposed neighboring layers of foamed plastic material, and means 7 for connecting spaced-apart portions of the two outer layers of the stuffing 3 with the adjacent panels of the case.

In accordance with a feature of the invention, each layer of the stuffing 3 is formed with a plurality of elongated straight slits 6 (see FIGS. 2 to 8) each of which extends all the way between the two sides of the respective layer and each of which is preferably disposed in a plane extending at right angles to the sides of the respective layer.

Figure 2:
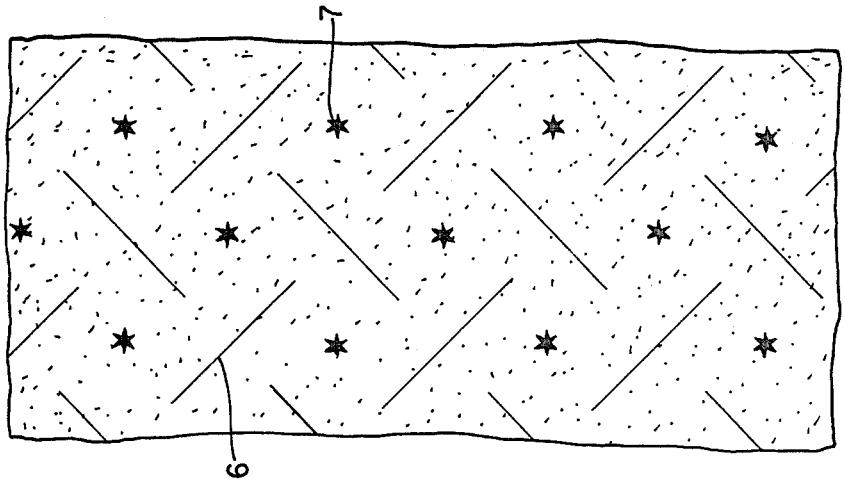
FIG. 2 is a fragmentary plan view of a layer with a first pattern of slits and connections to the adjacent panel of the case.
Figure 7:
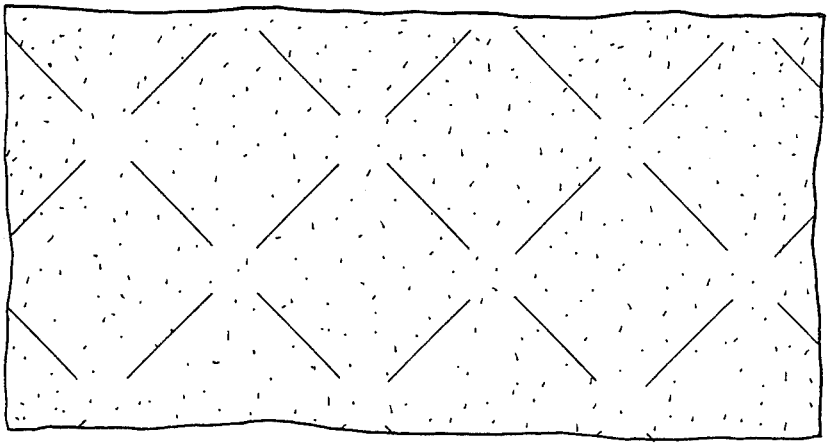

FIG. 2 shows a first pattern of slits 6. The arrangement is such that each slit 6 extends at right angles to all neighboring (immediately adjacent) slits 6. Each connection 7 can be formed by a spot of adhesive substantially at the center of a field which is surrounded by the four nearest slits 6. Such spots of adhesive can be replaced by connecting means including one or more yarns or threads, e.g., by connecting means obtained by stitching, sewing or an analogous procedure. If the materials of the panels 4, 5 are compatible with those of the adjacent layers of the stuffing 3, the layers can be welded to selected portions of the adjacent panels. Furthermore, and as shown in FIG. 1, one or more marginal portions of the layers which form the stuffing 3 can be secured to the adjacent marginal portions of the panels 4, 5 by stitches, lines of welding, lines of adhesive or in any other suitable way.

The distribution of connections 7 is such that these connections bond or otherwise permanently connect spaced-apart portions of the outermost layers of the stuffing 3 to the respective panels 4, 5 in such a way that the panels 4, 5 can move relative to the adjacent foamed layers when the cushion is in use, i.e., that the panel portions between neighboring connections 7 can flex, move toward the adjacent layers, move away from the adjacent layers and/or perform other movements relative to the stuffing 3. The point- or spot-shaped connections 7 can be replaced by linear connections or by combinations of point-shaped, linear and/or otherwise configurated connections. Neighboring panels of the stuffing 3 are or can be connected to each other along their marginal portions and/or at other locations. For example, the distribution of connections between neighboring layers of the stuffing 3 (if the stuffing comprises more than one layer) can be the same as the distribution of connections 7 between the panels 4, 5 and the neighboring outermost layers of the stuffing 3.

The panels 4, 5 can be made of a spunbounded fabric, of a woven or nonwoven fabric, of a knit fabric, of a foil or the like. Moreover, the color, thickness, softness, flexibility, weight, finish and/or other characteristics of one of the panels 4, 5 can but need not match the corresponding characteristic(s) of the other panel. For example, one of the panels can be much softer than the other panel.

The presently preferred slits 6 are straight. However, it is also possible to provide each layer of the stuffing 3 with arcuate, L-shaped, V-shaped, U-shaped and/or otherwise configurated slits. The elasticity of the layers can be influenced by appropriate configuration and/or dimensioning and/or distribution of slits.

If the stuffing 3 comprises two neighboring layers with mutually inclined elongated straight slits 6 of the type shown in FIGS. 2–4 and 7–8, if each layer is connected to the adjacent panel 4 or 5 of the case, and if the panels are connected to each other at a plurality of spaced-apart locations, the improved cushion is formed with a number of connections between the panel 4 and the adjacent layer of the stuffing 3, with a plurality of connections between the two layers of the stuffing 3, as well as with a plurality of connections between the other layer of the stuffing 3 and the panel 5. The connections can constitute spots, straight lines, arcuate lines, Vees and/or combinations of these with each other and/or with otherwise configurated connections.

The maximum thickness of the stuffing 3 need not exceed 81 mm, and the thickness of the thickest layer of the stuffing 3 (if the stuffing has two or more layers) need not exceed 41 mm. The stuffing 3 can be assembled of layers having identical or different thicknesses, and the thinnest layer need not be more than 2 mm thick.

The slits 6 are preferably distributed and dimensioned in such a way that they do not unduly affect the strength of the respective layers, i.e., that each layer can undergo a large number of washing or cleaning treatments.

Figure 6:
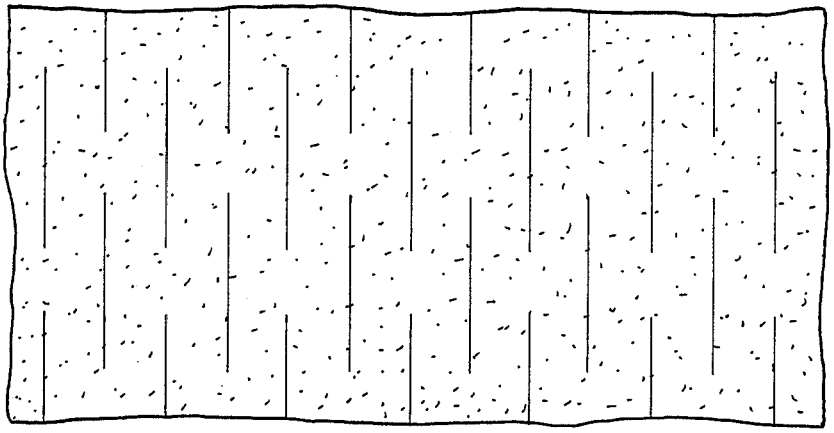
Figure 5:
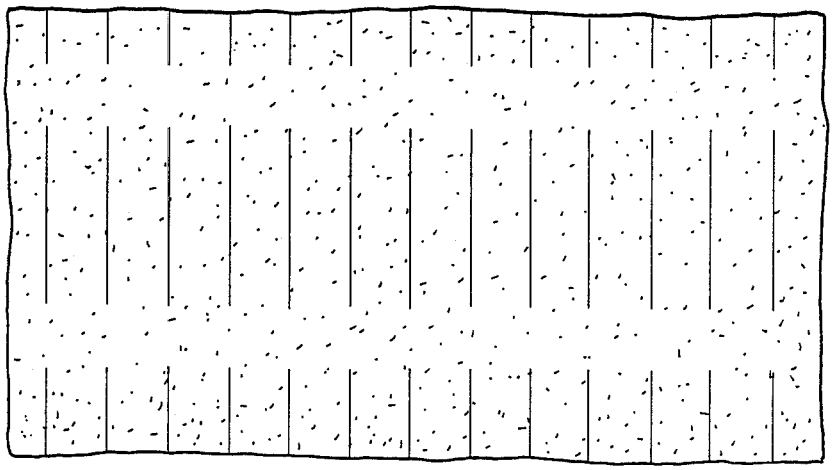
Figure 8:
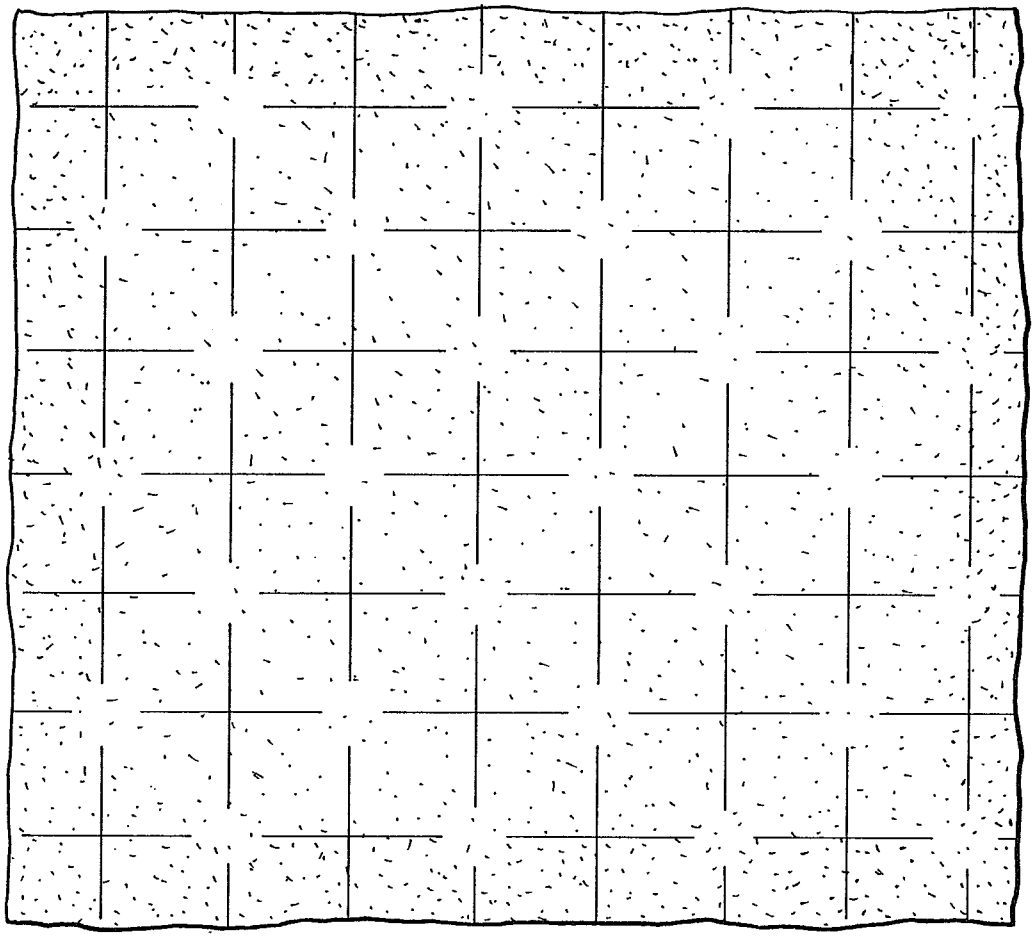

FIGS. 5 and 6 show that it is possible to provide foamed layers with rows of parallel slits, that the slits of one row can register with the slits of the neighboring row or rows, or that the slits in neighboring rows can be staggered with reference to each other. FIGS. 2 to 8 merely show some of presently preferred patterns of slits 6. Moreover, the distribution and orientation of slits in one of two or more foamed layers may but need not be identical with the distribution of slits in the adjacent layer or layers. The number of possible combinations is practically limitless. The central portion of each layer can be provided with a large number of slits per unit area, and the surrounding outer portion of each layer can be free of slits or can be provided with a smaller or much smaller number of slits per unit area. Still further, the dimensions of all slits in a particular layer may but need not be identical, and the same applies for the shape of slits in a particular layer.

An important advantage of the improved cushion is that it is more comfortable and more versatile than heretofore known cushions, especially those conventional cushions whose stuffing contains a foamed material. The improved cushion can be used with particular advantage in the automotive industries in passengers' compartments and drivers' cabins. In addition, the improved cushion can be used with advantage in hospitals, sanitaria and similar establishments for use by patients or convalescents to reduce the likelihood of the development of bedsores and similar problems. The improved cushion can be used with equal or similar advantage for the making of dolls, stuffed animals and other toys, furniture (especially upholstered furniture), mattresses, clothes and others.

Another important advantage of the improved cushion is that it can be mass-produced at a low cost. The parts of the cushion can be assembled in the form of sandwiches and the connections can be established without quilting which invariably leaves marks and prevents the making of cushions with smooth external surfaces. The absence of any need for full face-to-face lamination of the panels 4, 5 to the adjacent layers of the stuffing 3 prevents the development of the so-called sailcloth effect and ensures that the cushion exhibits a highly satisfactory elasticity because each layer of the stuffing can act as a discrete cushion. It has been found that the provision of slits 6 contributes to a more satisfactory elasticity of the foamed layers because the slits enhance the flexibility and reduce the stresses within the layers. All in all, the improved stuffing 3 and the cushion which embodies such stuffing can more readily yield in a desired manner to conform to the outline of a body than heretofore known cushions which employ bulky slabs of foamed material without slits and without spaced-apart connections to the case.

The slits 6 can be made in availabl machines, and the material of the layers is preferably a soft high-quality foam. The slits enhance the softness and elasticity of the layers because they eliminate or destroy surface tension. Moreover, the slits enable the material of the layers to breathe and they also enhance the conditioning of the respective layers. Still further, the slits enable the body of the occupant of a seat which is provided with the improved cushion to actually penetrate into the layers of the stuffing 3 rather than to merely depress and compress the layer or layers which, as proposed heretofore, constitute slabs of foamed material without any slits therein.

The provision of connections 7 between spaced-apart portions of neighboring layers and/or between spaced-apart portions of the outermost layers and the adjacent panels of the case ensures the establishment of air-filled compartments, especially when the improved cushion is in use in a toy, in a mattress, in a piece of upholstered furniture, in a motor vehicle, in a bed or elsewhere. The relatively large quantities of entrapped air contribute to smoothness, hand, pliability and other desirable characteristics of the cushion. The ability of the product to conform to a particular shape enhances the cushioning effect, and the ability of the case to stretch relative to the stuffing reduces the likelihood of development of the aforementioned sailcloth effect of the case.

Another important advantage of the improved cushion is its versatility. The aforediscussed desirable characteristics of the cushion and of its constituents can be achieved regardless of whether the cushion assumes a classical form (e.g., that of a customary pillow) or any other shape including that of a rod-shaped or spherical body, either alone or in combination with other cushions. By way of example, the improved cushion can be used as a coating to be applied around the core of a piece of upholstered furniture or around the skeleton of a mattress to enhance the appearance as well as to produce a desirable cushioning effect. In such instances, the cushion can comprise a stuffing having a thickness in the range of 20 mm and such stuffing can be composed of one or more layers of very soft high-quality foamed material. The softness can be established or enhanced by providing each layer of the stuffing with a large number of slits or with long or large slits so that the slits eliminate or greatly reduce the surface tension of the layers. As mentioned above, the softness and elasticity of the layers can be enhanced by properly selecting the dimensions and/or distribution of the slits. The provision of slits contributes to inertia of the respective layers (as far as the elastic properties of the layers are concerned) which is desirable when the cushion is placed onto a seat in a vehicle, on a piece of furniture or elsewhere. Thus, instead of exhibiting the typical characteristics of an elastic plate, each layer of the stuffing 3 is actually molded around the body which has caused the cushion to undergo deformation when the cushion constitutes a pillow, a portion of a piece of furniture, a part of a motor vehicle seat or a portion of a doll, stuffed animal or another toy. The arrangement may be such that the layer or layers nearest to the panel which is being sat upon or is being deformed in another way is or are softer than the other layer or layers of the stuffing.

The provision of connections 7 which are spaced apart from one another ensures that these connections do not detract from the appearance of the cushion even if the case is made of a very thin and readily deformable material including leather. In other words, the feature that the connections 7 between the outermost layer or layers of the stuffing 3 and the adjacent panels of the case are spaced apart from one another renders it possible to avoid the development of recesses in the outer side of the case, i.e., the outer sides of the panels 4 and 5 can be smooth and devoid of any depressions when the cushion is not in actual use.

It has been found that the improved cushion contributes to the comfort and that it can even improve the health of the user when the cushion is embodied in or used on a piece of furniture or a motor vehicle seat. This is due to the fact that the cushion can readily conform to the outline of the body resting thereon or bearing against it and, therefore, the cushion does not exhibit relatively soft and relatively hard portions which would be uncomfortable to the occupant or occupants. Moreover, such characteristics prolong the useful life of the cushion.

The foamed material of the layer or layers which form the stuffing 3 of the improved cushion can be the same as the materials of heretofore known foamed stuffings.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A cushion comprising a stuffing including at least one layer of foamed material, said at least one layer having a first side and a second side and a plurality of spaced, substantially straight slits extending all the way between said sides, each of said slits being disposed substantially at right angles to at least one neighboring slit and being located in a plane extending substantially at right angles to said sides, and each of said slits being free of intersections with the remaining slits; a case for said stuffing having two panels which define a pocket accommodating said stuffing; and means connecting spaced-apart portions of said at least one layer to said case in such a manner that each of said portions is held against said case.

2. The cushion of claim 1, wherein said stuffing includes a plurality of neighboring layers; and further comprising means for connecting spaced-apart portions of neighboring layers to each other.

3. The cushion of claim 2, wherein said means for connecting spaced-apart portions of neighboring layers to each other holds each such portion against the corresponding portion of a neighboring layer.

4. The cushion of claim 2, wherein each layer of said stuffing is composed of foamed material.

5. The cushion of claim 4, wherein each layer of said stuffing is composed of a soft foam.

6. The cushion of claim 2, wherein the spaced-apart portions of neighboring layers constitute lines or points.

7. The cushion of claim 1, wherein said case comprises a plurality of different portions.

8. The cushion of claim 1, wherein said at least one layer has a plurality of marginal portions; and further comprising means for securing at least one of said marginal portions to said case.

9. The cushion of claim 8, wherein said securing means includes stitches.

10. The cushion of claim 1, wherein said at least one layer has a central portion and an outer portion surrounding said central portion, said slits being provided at least in the central portion of said at least one layer.

11. The cushion of claim 10, wherein the number of slits per unit area of said outer portion is less than the number of slits per unit area of said central portion.

12. The cushion of claim 1, wherein the thickness of said stuffing is less than 81 mm.

13. The cushion of claim 1, in the thickness of said at least one layer is less than 41 mm.

14. The cushion of claim 1, wherein said at least one layer is composed of a soft foam.

15. The cushion of claim 1, wherein said case comprises a spun fabric, a woven fabric, a nonwoven fabric, a knit fabric or a foil.

16. The cushion of claim 1, wherein at least one of said portions constitutes a line or a point.

17. The cushion of claim 1, wherein said slits are arranged in groups and the slits of each group define a broken line, said groups being arranged to define a pattern of crisscrossing broken lines.

* * * * *